United States Patent [19]

Hipp

[11] 3,946,819

[45] Mar. 30, 1976

[54] WELL TOOL AND METHOD OF USE THEREFOR

[75] Inventor: James Edward Hipp, New Iberia, La.

[73] Assignee: Brown Equipment & Service Tools, Inc., Houston, Tex.

[22] Filed: Jan. 27, 1975

[21] Appl. No.: 544,070

[52] U.S. Cl. ..... 175/296; 173/78

[51] Int. Cl.[2] ..... E21B 1/06

[58] Field of Search ..... 166/315, 75, 311, 312; 173/73, 78, 80; 175/103, 296, 299

[56] References Cited

UNITED STATES PATENTS

| | | | |
|---|---|---|---|
| 2,813,516 | 11/1957 | Dulaney | 175/296 |
| 3,116,781 | 1/1964 | Rugeley et al. | 175/103 |
| 3,361,220 | 1/1968 | Brown | 175/296 |
| 3,702,223 | 11/1972 | Bednar | 175/103 |
| 3,791,447 | 2/1974 | Smith et al. | 166/311 |

*Primary Examiner*—James A. Leppink
*Attorney, Agent, or Firm*—Torres & Berryhill

[57] ABSTRACT

A tool adapted for connection to the lower end of a fluid supply line comprising: a housing; a tubular stem telescopically received by the housing for relative reciprocal movement therewith in response to fluid pressure communicated to the housing through the supply line; a working element attached to one end of the stem for movement therewith; and a valve assembly carried by the housing and responsive to predetermined movement of the stem relative to the housing to relieve fluid pressure within the tool, permitting a return of the stem and housing to their initial position relative to each other. In the method, the tool is attached to the end of a fluid supply line and inserted into a well conduit, the continuous supply line is inserted into the conduit until the tool reaches a preselected level; the tool is operated by applying fluid pressure thereto through the supply line; and the supply line is further fed into the conduit as the tool advances through the conduit. When the working element engages a firm obstruction, the housing and tubing are repeatedly reciprocated relative to the stationary bit imparting hammering blows thereto. When the working element is substantially free to move, it reciprocates relative to the stationary housing.

17 Claims, 7 Drawing Figures

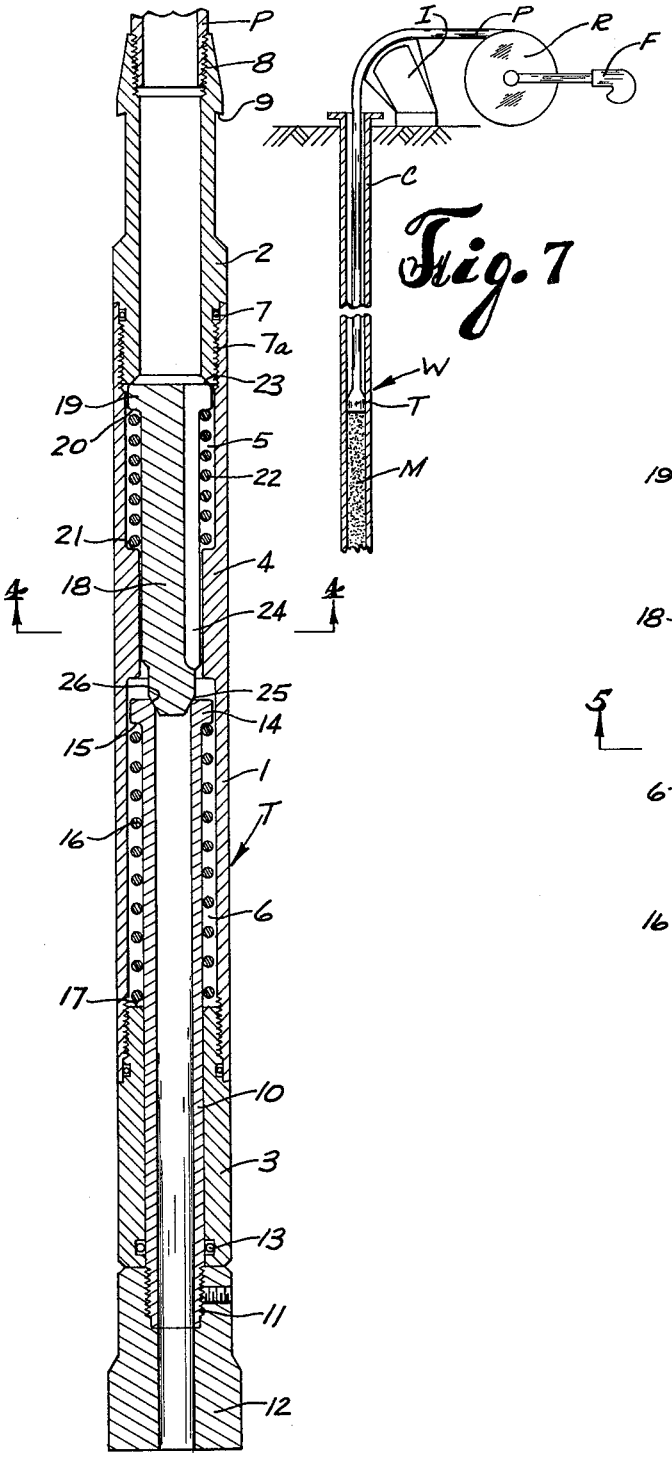
Fig. 7
Fig. 1
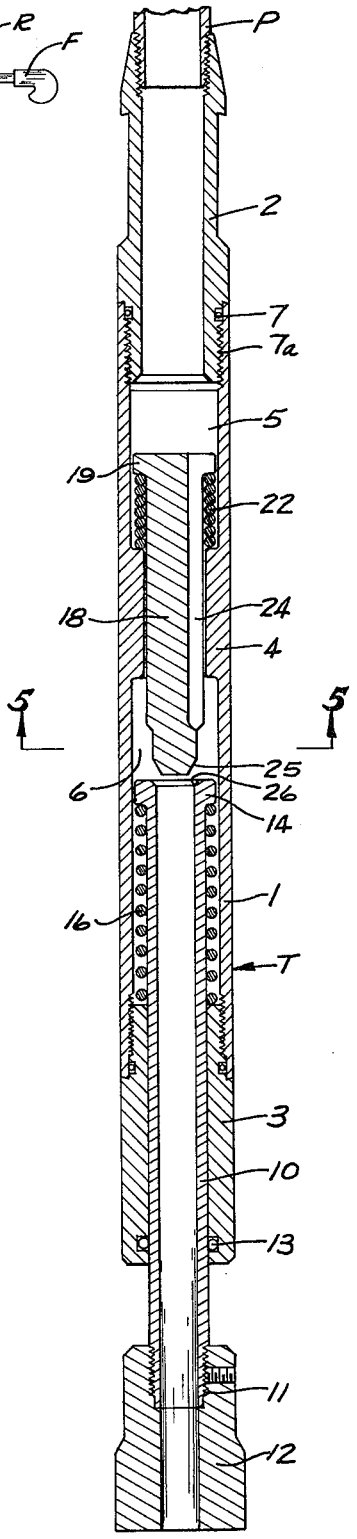
Fig. 2

WELL TOOL AND METHOD OF USE THEREFOR

BACKGROUND OF THE INVENTION

1. Field of the Invention

The present invention pertains to well tools and methods of use therefor. In particular, the present invention pertains to a tool for cleaning out, reshaping or reaming well conduits, or for making new hole in a well or for other uses. Specifically, the present invention pertains to well tools and methods for use thereof which are especially designed for use with continuous coiled pipe operations but which may advantageously be used with any suitable fluid supply line, including conventional jointed tubing. As used herein, the term "fluid" is intended to include both liquid and gas.

2. Background of the Prior Art

Drilling a well requires expensive equipment and operation. Usually the drill string comprises joints of pipe which are connected together as drilling progresses. A derrick is required for handling such pipe. In the past, it has been necessary, in changing a bit or in other operations, to pull the drill string, disconnecting and stacking joints of pipe. This also requires, in addition to the derrick, a considerable amount of time.

In the past, even working over a non-productive or malfunctioning well has required equipment capable of pulling strings of pipe and disconnecting the joints thereof. To eliminate derricks and associated equipment, some workover or remedial operations have been handled by running various tools into the well on a cable. However, cable workover methods have several limitations, including the inability to utilize fluid flow in the remedial operations.

In recent years, continuous pipe or tubing units have been developed to eliminate some of the problems of conventional workover operations. In the continuous tubing units, a continuous string of small diameter pipe or tubing is coiled on a reel device and the continuous pipe is fed through an injector device which straightens the tubing and feeds it from the reel down into the well. Such an operation eliminates the need for a derrick and for the time-consuming operation of connecting joints of pipe together. Coiled tubing units are described in U.S. Pat. Nos. 3,116,793; 3,313,346; and 3,346,045.

Coiled tubing units may be used for several types of workover operations. For example, wells having sand bridges or which are filled with sand from top to bottom may be cleaned by injecting the continuous pipe into the well while circulating fluids therethrough. Coiled tubing units are often used to "kick wells off," in place of gas lifting or swabbing, by injecting nitrogen or natural gas into the well or by replacing workover fluid with diesel or lease crude. Production zones may be acidized, inhibited, sand-consolidated, gravel packed, squeezed off or partially plugged back to shut off bottom water using coiled tubing units. Foreign matter in the tubing, such as paraffin, may be removed by circulation of hot oil or solvent through continuous coiled tubing units. It will be appreciated that such units are highly flexible in workover operations.

However, there may be situations where circulation of a fluid through a coiled tubing unit will not remedy the problems of a potentially productive well. For example, the well tubing may become plugged with inoperative equipment or foreign matter which cannot be dissolved or washed out by circulation of fluids. In other cases, the production tubing itself may be corroded, deformed or otherwise defective.

SUMMARY OF THE INVENTION

In the present invention, a tool is provided which is adapted for connection to the end of a fluid supply line. In the preferred form, the supply line is a continuous string of coiled tubing. Due to the torsional stresses involved and the impracticability of rotating a string formed from coiled tubing, conventional drill bits and other rotary tools are not suitable with such tubing. Therefore, the tools of the present invention have been designed for reciprocal, percussion type operation which are powered by pressurized fluids supplied through a supply line.

A preferred form of the invention comprises a drill tool which includes: a housing; a tubular stem member telescopically received in the housing for relative reciprocal movement therewith between a first terminal position and a second terminal position in response to fluid pressure communicated to the housing through the fluid supply line; a drill bit attached to one end of the stem member for movement therewith between its first and second terminal positions; and a valve assembly responsive to predetermined movement of the stem member toward its second terminal position to relieve fluid pressure and permit the stem member to return to its first terminal position. When the bit is against a firm surface, the fluid pressure and valve operation causes the housing and attached tubing to raise and lower relative to the stationary bit which in effect causes hammering blows to be delivered to the bit. Thus, a drill tool is provided with a hammered bit for drilling out stubborn foreign matter within a well. Although it is not primarily intended for such use, such a drill tool may even be used to initially drill or "make hole" for a new well.

In workover operations, where a tubing is to be cleared of sand or other material, the drill tool is attached to one end of a reel of continuous pipe and inserted into the well conduit, the continuous pipe is fed from the reel into the conduit until the drill tool reaches a preselected level and the drill tool is then operated by applying hydraulic or pneumatic pressure thereto through the continuous pipe. As the drill tool advances through the conduit, the continuous pipe is fed from the reel into the well conduit. When a solid obstacle is encountered, the valve assembly of the tool is operable in response to reciprocation of the housing relative to the drill bit to open and close providing intermittent fluid flow from the continuous pipe string into the well conduit. When no substantial opposition is met by the bit, the bit reciprocates relative to the stationary housing. The combined bit action and fluid flow serves as an aid in washing out or eroding unwanted foreign matter and in removing cuttings or dislodged material from the well conduit.

Thus, with the drill tool of the present invention, the continuous coiled tubing units of recent development can be made even more flexible and useful for working over wells. Such flexibility and reduced operational costs are extremely important in solving the energy problems of today. Other objects and advantages of the invention will be apparent from a reading of the specification which follows in conjunction with the accompanying drawings.

BRIEF DESCRIPTION OF THE DRAWINGS

FIG. 1 is an elevation view, in section, of a drill tool according to an embodiment of the invention, in which the bit is shown in its running or retracted position;

FIG. 2 is a sectional elevation view of the drill tool of FIG. 1 showing the bit in an extended position;

FIG. 7 is a schematic representation of a drill tool, such as the one shown in FIGS. 1—6, attached to the end of a coiled tubing unit for removing foreign matter from a well conduit.

DESCRIPTION OF THE PREFERRED EMBODIMENT

Figure 3:
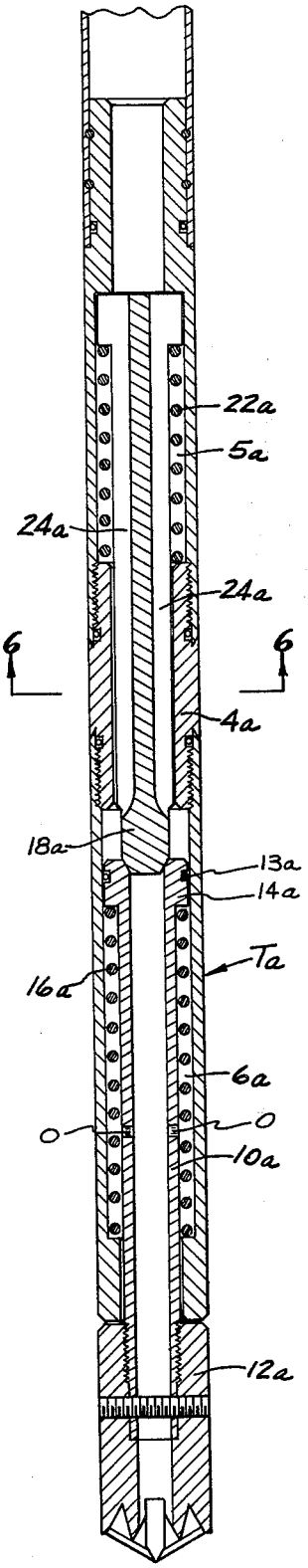
FIG. 3 is a sectional elevation view, similar to FIG. 1, showing a preferred embodiment of the invention.
Figure 4:
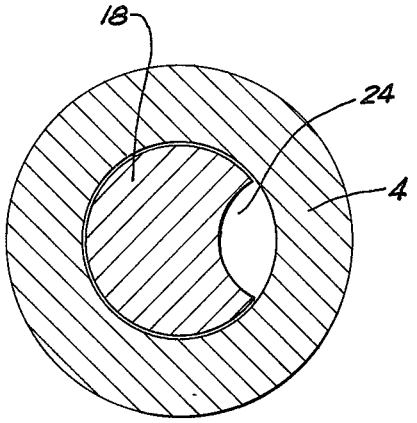
FIG. 4, taken along line 4—4 of FIG. 1, is a horizontal cross-sectional view of the drill tool of FIG. 1.
Figure 5:
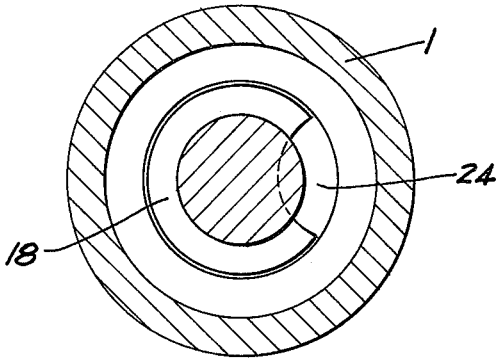
FIG. 5, taken along line 5—5 of FIG. 2, is another horizontal cross-sectional view of the tool of FIGS. 1 and 2.

Referring first to FIGS. 1, 2, 4 and 5, there is shown a drill tool T, according to one embodiment of the invention. The drill tool T may comprise a housing made up of a tubular body 1, a running and pulling sub 2, and collar or hammer 3. The bore of the body 1 may be reduced at 4 so as to provide an upper annular chamber 5 and a lower annular chamber 6.

The running and pulling sub 2 may be threadedly attached, as at 7*a*, to the body 1 and provided with a suitable seal 7 for such connection. Sub 2 may also be provided with upper threads 8 by which the drill tool may be attached to the lower end of a pipe string P. The exterior of the sub 2 may be relieved so as to provide a downwardly facing annular surface 9 by which the drill tool may be retrieved in the even that it becomes disconnected from the pipe string P for any reason.

Telescopically received within the housing is a tubular stem member 10 to the lower end of which is attached, by threads 11 or the like, a suitable drill bit 12 or other working element. The working element 12 may be referred to as the cooperating "anvil" for hammer 3. The stem member 10 slidingly engages the bore of collar 3 so that it may be reciprocated, relative thereto, between a first terminal position, as shown in FIG. 1, and extended positions such as shown in FIG. 2. An annular seal 13 may be carried by the collar 3 to provide a sliding seal between the housing and tubular stem 10.

The upper portion of the tubular stem 10 may be provided with an annular flange or extension 14 for reciprocation within the chamber 6. The flange portion 14 creates a downwardly facing shoulder 15 against which one end of a helical biasing spring 16 may rest. The other end of the spring 16 is in contact with the upwardly facing annular surface 17 provided by collar or hammer 3. The spring 16 biases the stem member 10 toward the first or upper terminal position shown in FIG. 1.

Also disposed within the housing is a plunger 18. The diameter of the plunger 18 is such as to fit closely but slidingly within the reduced bore portion 4 of the housing body 1. The plunger member may also be provided with an annular flange or extension 19 for limited relative reciprocation within annular chamber 5. The plunger flange 19 and reduced bore of housing body 1 provide downwardly and upwardly facing shoulders 20 and 21, respectively, between which is disposed a second helically wound biasing spring 22. The spring 22 biases the plunger member 18 toward an upper or first terminal position against a shoulder 23 provided by running and pulling sub 2. It should be noted that the free length and solid height difference of the stem spring member 16 is greater than that of the plunger spring member 22.

The plunger member 18 may be provided with at least one elongated passageway 24 through which fluid communication is established between the first and second annular chambers 5 and 6. The purpose of such communication will be more fully understood hereafter.

The lower end of plunger 18 may be tapered, as at 25, to sealingly engage a correspondingly tapered seat 26 provided at the upper end of stem member 10. The plunger 18 and upper end of stem member 10 cooperate as a valve or control device by which relative reciprocation of the stem member 10 and drill bit 12 can be effected.

Figure 6:
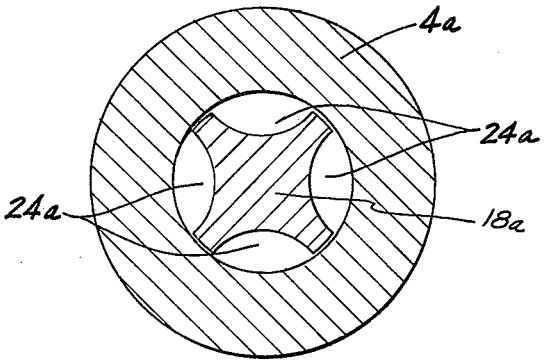
FIG. 6, taken along line 6—6 of FIG. 3, is a horizontal cross-sectional view of the alternate drill tool of FIG. 3.

The preferred embodiment of the drill tool, as illustrated in FIGS. 3 and 6, is essentially the same as the embodiment of FIGS. 1 and 2. One difference lies in the provision of a plurality of elongated passageways 24*a* for providing fluid communication between annular chambers 5*a* and 6*a*. Another is placement of seal ring 13*a* on the flange member 14*a* rather than on the collar, as in the previously described embodiment. This provides a larger effective pressure area on the stem 10*a* than in the previous embodiment. To prevent the build up of opposing pressures within the lower portion of chamber 6*a*, ports O are provided in stem 10*a*. This eliminates large opposing pressures below seal 13*a*, but provides some positive pressure to prevent entry of sand or other deleterious materials into the chamber 6*a* on upward movement of stem 10*a* relative to the surrounding housing. In other respects, the preferred drill tool T*a* is essentially the same in construction and operation as the previous tool embodiment T.

It should be understood that although drill bits 12 and 12*a* have been shown with these embodiments other "working elements" such as broaches, swedging devices, simple driving members or the like may be used. The type of working element depends on the job the tool is called on to perform.

STATEMENT OF OPERATION

Referring now also to FIG. 7, operation of the present invention for working over a well will be described. Schematically illustrated in FIG. 7 is a well W having a tubing string or conduit C which has become plugged by unwanted foreign matter M. A coiled tubing unit is provided including a reel or coil R of continuous pipe P and an injector device I. No further description of the reel R and injector device I is needed since these items known in the industry.

In operation, a drill tool T, such as the ones shown in FIGS. 1, 2, 4 and 5 would be attached to one end of the reel of continuous pipe P. The tool T and continuous pipe would be inserted into the conduit C, after straightening by the injector unit I, and the continuous pipe fed from the reel R until the drill tool T reaches a preselected level, for example the level of unwanted foreign matter M. At this point, fluid pressure would be applied to the tool T through the continuous pipe string, such as by pump F, for operation thereof. Although hydraulic operation is described it should be understood that gases, such as compressed nitrogen, may also be used in the present invention.

As pressure is communicated to the well tool T, the housing and pipe string P are forced upwardly, relative to the plunger 18, stem member 10 and drill bit 12, due to the pressure differential between the pipe string P and the conduit C. This pressure is communicated to the plunger 18 and, via passageway 24, to the upper end of stem member 10.

The housing moves upwardly until the biasing spring 22 reaches its solid height, arresting relative movement between the housing and plunger 18. At this point, the tapered end 25 of the plunger 18 is lifted from the seat 26, provided on the upper end of stem member 10 (opening the valve). Once the valve is open, fluid may flow through the stem member 10 and drill bit 12, allowing pressure to equalize within the tool T. Upon relief of pressure, the weight of the pipe string P and the compressive forces created therein forces the housing to return to its original or first terminal position. During this movement, compressed springs 22, 16, plunger 18, and stem member 10 return to their relative initial or first terminal positions. When the housing is forced to return to its initial position, a percussion blow is delivered by the hammer 3 to the anvil or working element 12.

The internal pressure within the pipe string P is then allowed to rise to the point necessary for again forcing the housing and pipe string P upwardly relative to the plunger 18 and stem 10. This cycle continues, causing the housing to continue in a reciprocating motion imparting blows to the working element 12 for pushing or drilling out the unwanted matter M within the conduit C. As previously mentioned, this drilling is also aided by the intermittent flow of fluid through the stem 10 when the valve is open. This flow also aids in returning cuttings or dislodged matter to the surface of the well through conduit C. As the drill tool advances through the conduit C, the continuous pipe P is fed from the reel R.

It can easily be understood that if the unwanted matter within conduit C is relatively soft, such as paraffin, the housing may remain stationary while the plunger 18 and stem 10 move downwardly under the influence of fluid pressure in the pipe string P. The movement of the various components of tool T described herein are, therefore, relative.

It should also be understood that several types of working elements may be used in place of the bit 12 shown herein. A broach tool may be used to chisel or ream out the inside of a conduit which has been "dimpled" or bent so as to create an unwanted obstruction in the conduit. A swaging tool may be used to reshape the interior of a conduit. A simple punching type tool may be used to drive irretrievable inoperable tools or control devices out the bottom of a conduit. In fact, plugs such as those used to plug the end of a conduit may even be driven out with a punching type tool. These are merely examples, without limitation, of working elements which may be substituted for bit 12.

Although the drill tool and method of the present invention have been described primarily for use in workover operations, it is conceivable that such a tool may be used to initially drill or make new well hole, particularly for shallow wells. In fact, many variations and uses of the invention can be made by those skilled in the art without departing from the spirit of the invention. It is therefore intended that the scope of the invention be limited only by the claims which follow.

I claim:

1. A well tool comprising:

a. a housing having means for connecting said tool in fluid communication with the lower end of a pipe string and defining at least one annular chamber therein;

b. tubular stem means telescopically received by said housing for relative reciprocal movement and sealing engagement therewith between a first terminal position and a second terminal position in response to fluid pressure communicated to said housing through said pipe string;

c. a working member attached to one end of said stem means for said relative movement therewith between said first and second terminal positions;

d. valve means carried by said housing responsive to predetermined movement of said stem means, relative to said housing, to relieve said fluid pressure, permitting return of said stem means and housing to said first terminal position; and e. biasing means disposed in said annular chamber biasing said stem member and housing toward said first terminal position and biasing said valve into a closed position when said stem member and housing are in said first terminal position.

2. A well tool as set forth in claim 1 in which the upper portion of said stem means is of an enlarged diameter which sealingly engages said annular chamber and reciprocates relative thereto, port means being provided through the walls of said stem means providing fluid communication between the interior of said stem means and said annular chamber.

3. A well tool as set forth in claim 1 in which said biasing means comprises a spring member disposed between an upwardly facing surface of said annular chamber and a downwardly facing surface on said enlarged diameter portion of said stem means.

4. A well tool as set forth in claim 3 in which said valve means comprises an annular seat at the upper end of said stem means and a plug member engageable therewith.

5. A well tool as set forth in claim 4 in which said housing defines a second annular chamber in which the upper portion of said plug member is disposed for relative reciprocation therein between a first terminal position and a second terminal position, said biasing means biasing said stem means toward its first terminal position for sealing engagement of said annular seat with said plug member when said plug member is in its first terminal position.

6. A well tool as set forth in claim 5 including second biasing means carried by said housing for biasing said plug member in a direction away from said seat.

7. A well tool as set forth in claim 6 in which said second biasing means comprises a spring member disposed between an upwardly facing surface of said second annular chamber and a downwardly facing surface on said plunger member.

8. A well tool as set forth in claim 7 in which the free length and solid height difference of said stem spring member is greater than that of said plunger spring member.

9. A well tool as set forth in claim 8 in which said plunger member communicates with said seat through a reduced diameter bore between said first and second annular chambers.

10. A well tool as set forth in claim 9 in which said first and second chambers are at all times in fluid communication through an elongated passage in said plunger member.

11. A well tool as set forth in claim 1 in which said stem means and said working member define a passageway through which fluid communication may be established between said pipe string and the exterior of said tool when said valve means is opened.

12. A well tool as set forth in claim 11 in which said valve means comprises an annular seat surrounding said passageway at the upper end of said stem member and a plunger member carried by said housing means for engagement therewith to close said valve means.

13. A well tool as set forth in claim 12 in which said biasing means biases said stem means and housing toward said first position in which said valve means is always in a closed position.

14. A well tool as set forth in claim 13 in which said plunger means remains fixed relative to said stem means during at least initial relative movement of said stem means toward said second terminal position.

15. A well tool as set forth in claim 14 including means for stopping movement of said plunger means, relative to said housing, while said stem means is allowed to continue movement toward said second terminal position, so as to disengage said plunger and seat, opening said valve means.

16. A well tool as set forth in claim 15 including second biasing means biasing said plunger means in a direction away from said engagement with said seat means.

17. A well tool as set forth in claim 16 in which said first mentioned biasing means biases said stem means toward said plunger means.

* * * * *